United States Patent [19]

Bergloff et al.

[11] 4,410,304

[45] Oct. 18, 1983

[54] FREE PISTON PUMP

[75] Inventors: Raymond A. Bergloff, Woodland Hills; James T. Hollis, Fountain Valley; Oswald A. Walkes, Northridge, all of Calif.

[73] Assignee: HR Textron Inc., Valencia, Calif.

[21] Appl. No.: 332,389

[22] Filed: Dec. 21, 1981

[51] Int. Cl.[3] ..... F04B 17/00

[52] U.S. Cl. ..... 417/346

[58] Field of Search ..... 417/344, 345, 346, 339

[56] References Cited

U.S. PATENT DOCUMENTS 2,212,667 8/1940 Mayor ..... 417/346

2,858,767 11/1958 Smith ..... 417/346

*Primary Examiner*—Richard E. Gluck

*Attorney, Agent, or Firm*—Nilsson, Robbins, Dalgarn, Berliner, Carson & Wurst

[57] ABSTRACT

A pumping system which converts a source of gas under pressure to hydraulic fluid under pressure. The system includes three free floating pistons coupled through control valves to the pressurized gas source on one side and through appropriate check valves to hydraulic fluid on the other side. The pistons are reciprocated within respective cylinders by application of the pressurized gas to one side thereof and by application of the return pressure of the hydraulic fluid to the other side thereof. Appropriate porting on the gas side of the pistons sequentially applies the gas under pressure to the three pistons to synchronize reciprocation of them so as to provide a continuous flow of fluid under pressure, upon demand, to a load.

10 Claims, 1 Drawing Figure

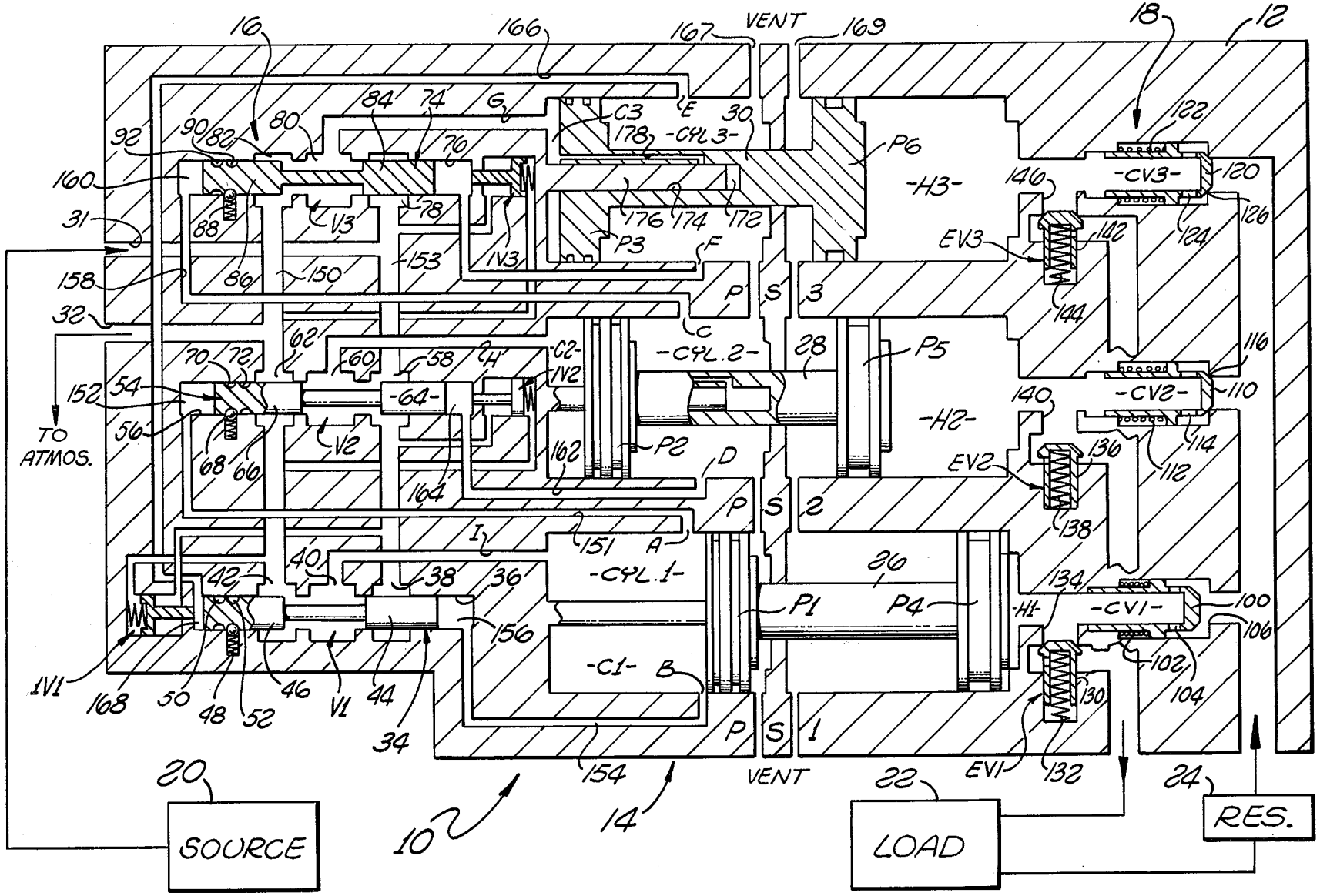
RES.
LOAD
SOURCE
VENT
VENT
TO ATMOS.
-CV3-
-CV2-
-CV1-
-H3-
-H2-
-H1-
-CYL.3-
-CYL.2-
-CYL.1-
-C1-
-C2-
-C3-
-C4-
EV3
EV2
EV1
P1
P2
P3
P4
P5
P6

FREE PISTON PUMP

BACKGROUND OF THE INVENTION

The use of gas under pressure for driving free floating pistons to pump hydraulic fluid has long been known. Such pumps have been utilized to eliminate the necessity of employing motor driven pumps of the electrical type. The most pertinent prior art known to applicants is disclosed in U.S. Pat. No. 2,858,767, to N. V. Smith which employs a dual pump four-way control valve. Such apparatus is difficult to synchronize and to maintain operable under all load conditions. In addition thereto, since only two pistons are utilized the output fluid is pulsating.

SUMMARY OF THE INVENTION

A gas operated, free piston pumping apparatus which has at least three piston assemblies, each of which is operably connected to a separate three-way control valve. Each of the control valves has first and second positions. Means is provided for positioning the control valve in its first position responsive to another piston assembly approaching the completion of its exhaust stroke. When in its first position, gas under pressure is provided from the source thereof to the control valves associated piston assembly. Means is also provided for positioning the control valve in its second position when its associated piston assembly is completing its exhaust stroke. When in its second position the gas under pressure is removed from its associated piston assembly and the assembly is vented.

More specifically, each of the at least three piston assemblies is positioned to reciprocate within respective cylinders which are divided into a gas portion and a hydraulic portion. The source of gas under pressure is connected through appropriate control valves to the gas portion of each of the cylinders. Each of the gas portions of the cylinders includes two control ports positioned in spaced apart portions at the end of the piston exhaust (power) stroke. As the first port is opened by the piston, gas pressure is applied through an appropriate passageway to position the control valve for a second piston assembly to commence its power stroke. As the second port is opened at the end of the power stroke of the first piston assembly, the control valve for that piston assembly is actuated to disconnect it from the source of gas under pressure and to connect it to return. Therefore, it can be seen that each of the cylinders is pressurized with a gas under pressure prior to the end of the power stroke of the preceding cylinder to maintain a constant output hydraulic pressure at all times.

BRIEF DESCRIPTION OF THE DRAWINGS

The single FIGURE is a schematic diagram of a free piston pump assembly constructed in accordance with the principles of the present invention.

DESCRIPTION OF THE DISCLOSED EMBODIMENT

As is shown in the drawing, there is disclosed a free piston pump system 10 which includes a housing 12 within which there is disposed a pumping portion 14 having associated therewith gas control valves 16 and hydraulic control valves 18. The gas control valves 16 control the application of gas under pressure from a source 20 thereof to the gas portion of the pumping portion 14. The hydraulic valve section 18 controls the flow of hydraulic fluid under pressure from the hydraulic portion of the pumping portion 14 to the load 22 and from the reservoir 24.

The gas control valves 16 function responsive to positioning of the pistons within the pumping portion 14. As a piston approaches the completion of its power stroke it activates a control valve to sequentially apply the pressurized gas to a next successive pumping section. As the piston approaches the end of its power stroke it vents the gas portion of the cylinder to gas return or atmosphere thereby allowing the hydraulic fluid under reservoir pressure to return the piston and fill the hydraulic section of the valve preparatory to the next power or exhaust stroke. Thus a continuous flow of hydraulic fluid under pressure is provided responsive to the application of gas under pressure to the pumping portion 14 of the free piston pump assembly.

The pumping portion 14 includes three separate pump sections PS1, PS2 and PS3. PS1 is shown in a position such that the exhaust or power stroke where hydraulic fluid under pressure has been expelled responsive to gas under pressure being applied thereto has been completed. PS2 is shown at the commencement of its power stroke. PS3 is at the ready position to commence the power stroke; in this position the hydraulic section of PS3 is completely filled with fluid ready for expulsion in response to the application of gas under pressure. However, no gas under pressure is being applied to PS3.

PS1 includes cylinder 1 which is divided into chambers C1 and H1, gas under pressure being applied to chamber C1 while hydraulic fluid is present in chamber H1. Reciprocally positioned within cylinder 1 are pistons P1 and P4 interconnected by piston rod 26. Piston P1 is positioned within chamber C1, while piston P4 is positioned within the chamber H1. Chamber C1 defines a pair of longitudinally displaced ports A and B adjacent that portion of the chamber C1 occupied by the piston P1 at the end of the power stroke thereof. It should be noted that port A is opened by piston P1 prior to port B. However, at the end of the power stroke of piston P1, both ports A and B are open.

Pump section PS2 is constructed similarly to that of PS1 and includes a cylinder 2 divided into chambers C2 and H2 within which are positioned pistons P2 and P5, respectively. The pistons P2 and P5 are interconnected by piston rod 28. Ports C and D are positioned within chamber C2 and are disposed as described with respect to chambers A and B.

Piston section PS3 is similar to the previously described sections and includes a cylinder 3 divided into chambers C3 and H3 within which are positioned pistons P3 and P6 which are interconnected by a piston rod 30. Chamber C3 defines ports E and F which are positioned as previously described.

The gas control valve section 16 includes three valves V1, V2 and V3. Control valve V1 is associated with pump section PS1, control valve V2 is associated with pump section PS2 and control valve V3 is associated with pump section PS3. Each of the valves V1, V2 and V3 controls the application of gas under pressure from the source 20 to the chambers C1, C2 and C3, respectively, or alternatively controls the venting of the chambers C1, C2 and C3 to gas return or atmosphere as shown at the outlet port 32.

The valve V1 includes a spool 34 positioned within a cylinder 36 which defines ports 38, 40 and 42. Lands 44 and 46 upon spool 34 open and close ports 38 and 42, respectively, to connect chamber C1 to the source of gas under pressure 20 or return, respectively. Spool 34 is positionable in only one of two positions which is controlled by a detent 48 which when positioned in the recess 52 holds the spool 34 in the position shown in FIG. 1 and when positioned in the recess 50 holds it in such a position that port 42 is closed and port 38 is opened.

The valve V2 is constructed similarly to the valve V1 and includes a spool 54 movably mounted within a cylinder 56 which defines ports 58, 60 and 62. The lands 64 and 66, respectively, open and close the ports 58 and 62. A detent 68 positions the spool 54 in its two positions represented by the recesses or grooves 70 and 72. When in the position shown in the drawings, land 64 opens port 58 and supplies pressure to chamber C2.

Valve V3 is similar to valves V1 and V2 and includes the spool 74 positioned within the cylinder 76 which defines ports 78, 80 and 82. The lands 84 and 86 open and close the ports 78 and 82, respectively. The detent 88 is positioned within the recesses or grooves 90 and 92 to position the spool 74 in one of its respective positions. When in the position as shown in FIG. 1, port 82 is open, connecting the gas return or atmosphere to chamber C3.

The hydraulic valve section 18 includes two sets of three each of spring loaded check valves. The check valves, CV1, CV2 and CV3 control the application of hydraulic fluid from the reservoir 24 to the chambers H1, H2 and H3, respectively. CV1 includes a poppet valve 100 which is continuously urged toward the right as viewed in the FIGURE by the spring 102. The poppet 100 defines a port 104 through which hydraulic fluid flows into the chamber H1 when the poppet 100 is in the position as shown in the FIGURE. A valve seat 106 receives the poppet 100 to preclude the flow of hydraulic fluid from the reservoir 24 into the chamber H1 when gas pressure is applied to chamber C1 and the piston P4 is pumping hydraulic fluid as will be described more fully below.

CV2 is identical to CV1 and includes a poppet 110 which is continuously urged toward the right by the spring 112 and which defines the port 114. A seat 116 receives the poppet 110 to block the flow of fluid as described below.

The valve CV3 is identical to the valves CV1 and CV2 and includes a poppet 120 which is spring loaded toward the right by the spring 122 and which defines a port 124 through which fluid flows from the reservoir 24 into the chamber H3. A seat 126 receives a poppet 120 to seal and block the flow of the fluid into the chamber H3.

Valves EV1, EV2 and EV3 are spring loaded poppet valves which function to permit the flow of fluid under pressure from the chambers H1, H2 and H3 during the power stroke of the pump sections PS1, PS2 and PS3, respectively. EV1 includes the poppet 130 which is spring loaded by the spring 132 upwardly as viewed in the FIGURE to close the port 134 when in the position shown and thus to block the flow of fluid through the outlet to the load 22. It will thus be recognized that the piston P4 has traveled to the end of its power stroke so that no more hydraulic fluid is being pumped from the chamber H1 to the load 22. Thus the spring 132 has positioned the poppet 130 to seal the port 134. Since, as will be described more fully below, spool 34 has opened port 42, chamber C1 is vented to atmosphere and therefore the fluid under reservoir pressure has opened valve CV1 to allow the hydraulic fluid to enter chamber H1 and commence to move pistons P1, P4 toward the left thereby filling the chamber H1 with hydraulic fluid.

Valve EV2 is similar to the valve EV1 and includes the poppet 136 which is spring loaded by the spring 138 to control the port 140. As will be recalled from the previous description as a result of the position of the spool 54 of valve V2, gas under pressure is applied through the port 58 and 60 to the chamber C2 thereby pressurizing it and causing the pistons P2 and P5 to move to the right as shown in the FIGURE. Such movement applies pressure to the hydraulic fluid in the chamber H2, thereby opening the port 140 against the force of the spring 138 and allowing hydraulic fluid under pressure to flow through the outlet and to the load 22.

Valve EV3 is similar to valves EV1 and EV2 and includes the poppet 142 which is spring loaded to the position shown in the FIGURE by the spring 144 to close the port 146. As will be previously recalled spool 74, in the position shown, connects atmosphere through the ports 82 and 80 to the chamber C3. Hydraulic fluid has previously flowed through CV3 to fill chamber H3 in such a fashion that the piston assembly of PS3 has moved toward the left, completely filling the chamber H3 with hydraulic fluid thus readying pump section PS3 to pump the hydraulic fluid therefrom when gas under pressure is applied from the source thereof to the chamber C3.

As is shown passageways G, H and I connect the chambers C3, C2 and C1, respectively to the ports 80, 60 and 40, respectively. The outlet port 32 which exhausts to atmosphere is connected by the passageway 150 to the ports 42, 62 and 82. On the other hand, the passageway 153 applies gas under pressure from the source 20 thereof through the inlet 31 to the ports 38, 58 and 78.

OPERATION OF THE SYSTEM

It will be recognized by those skilled in the art that the system as disclosed in the drawing as above described will function in such a manner that each of the three pump sections will sequentially be activated to pump hydraulic fluid under pressure from each of the chambers, respectively, through the outlet and to the load. The next succeeding pump section will be pressurized and will commence to pump as the preceding pump section piston nears the conclusion of its power stroke. There will thus be momentarily two piston sections simultaneously exhausting hydraulic fluid to the load. In this fashion pulsations in the outlet flow are substantially eliminated.

To accomplish the foregoing it will be assumed that piston P1 is in a position such that it is toward the left from that shown in the FIGURE so that ports A and B are both closed and it will further be assumed that the spool 34 is in its position toward the right from that shown in the drawing so that port 42 is closed and port 38 is opened, thereby pressurizing chamber C1. In this condition the pistons in pump section PS1 are in the power stroke but are nearing the end thereof. As the piston P1 passes port A, it is opened thereby applying the pressure present in the chamber C1 through the passageway 151 to the chamber 152 at the left side of the spool 54 of valve V2. Such pressurization moves the valve V2 to the position illustrated in the FIGURE, thus opening the port 58 and applying the gas under pressure through the passageway H to the chamber C2 thus pressurizing the same and starting the pistons of pump section PS2 toward the right, thereby starting the flow of hydraulic fluid through the port 140 and through the outlet to the load 22. At the same time piston P1 continues to move toward the right since chamber C1 is still pressurized until such a time as port B is opened. When port B is opened the pressure within the chamber C1 is applied through the passageway 154 to the chamber 156 at the righthand side of the spool 34. The gas thus applied, moves the spool 34 toward the left to the position as shown in the FIGURE, thus closing the port 38 and removing gas from the chamber C1 and at the same time opening the port 42 and connecting chamber C1 to the port 32 which leads to atmosphere. Thus chamber C1 is now vented to atmosphere thereby allowing the hydraulic fluid in the inlet passageway to move CV1 to the left as shown in the drawing. Such movement allows hydraulic fluid to pass through the port 104 in the poppet 100 and to enter the chamber H1, thereby moving pistons P4 and P1 toward the left as viewed in the drawing.

A similar operation to that described above will occur with respect to pump sections PS2 and PS3. For example, as piston P2 opens port C, gas under pressure is applied through passageway 158 to the chamber 160 at the left side of the spool 84 moving it to the right so that detent 88 engages the groove 90 thereby closing port 82 to remove atmosphere from the chamber C3. At the same time port 78 is opened to apply gas under pressure through passageway G to the chamber C3. This action starts the pistons in pump sections PS3 toward the right which will pressurize the hydraulic fluid in chamber H3. Such pressurization opens port 146 by pushing the poppet 142 downwardly to thus commence to apply hydraulic fluid under pressure through the outlet and to the load, just prior to the completion of the power stroke by the pump section PS2. As port D is opened by piston P2, gas under pressure in chamber C2 is applied through the passageway 162 to the chamber 164 at the right of the spool 54. This causes the spool 54 to move toward the left so that detent 68 engages the groove 72, thereby fixing the spool 54 in its other position to open chamber C2 to atmosphere through now open port 62 and at the same time closing off port 58 from the source of pressure. As the pistons in pump section PS3 conclude their strokes, piston P3 first will open port E applying gas pressure in chamber C3 through the passageway 166 to the chamber 168 at the left of spool 34 moving it toward the right so that the detent 48 engages the groove 50 to thereby close the port 42 and open the port 38 thus applying gas under pressure to the cylinder C1 causing it to move toward the right thus repeating the cycle as previously described.

The valves IV1 and IV2 and IV3 are each associated with the control valves V1, V2 and V3, respectively. The valves IV1, IV2 and IV3 are used to preposition the control valves before system start up. It is noted that each of IV1, IV2, and IV3 includes a spring loaded plunger 168 which in response to the urging of the spring and in the absence of gas under pressure will position valve V1 in its rightmost position and valves V2 and V3 in their leftmost position as viewed in the FIGURE. Upon the application of gas under pressure to the conduit 153 each of the plungers is retracted to the position shown in the drawing and will not function until the gas under pressure is removed from the system. The positioning of the valves V1, V2 and V3 by the plungers IV1, IV2 and IV3 places the valves in an appropriate position so that the sequencing as above described will always occur upon application of pressure to the system.

It will also be noted that the non-pressure sides of cylinders 1, 2 and 3 are vented to atmosphere as shown at 167, and 169. Thereby any leakage which occurs of either the gas or the hydraulic fluid past the respective gas or hydraulic pistons and valves of the pump sections PS1, PS2 and PS3 will vent to atmosphere.

For purposes of limiting the travel of the piston assemblies in pump sections PS1, PS2 and PS3, there is provided a fluid capture volume, which is best illustrated in PS1 and PS3. As shown in the drawing, when the piston assembly is all the way to the right (PS1) an annular volume 170 of hydraulic fluid is captured between the piston P4 and the wall of the chamber H1. The captured volume of fluid restricts the further movement of the piston assembly and precludes bottoming out thereof. By reference to PS3 a similar capture volume 172 is provided in a reentrant bore 174 defined by the rod 30. The bore receives a guide rod 176 therein. The bore 174 is vented by a passageway 178 to define the volume 172. Thus when the end of the rod 176 passes the vent 178, the fluid (gas) remaining in the volume 172 functions to limit travel of the piston assembly beyond the compressibility thereof.

There has thus been illustrated and described a three piston pump which converts gas pressure to hydraulic fluid under pressure provides a steady stream only upon demand by the load which flow is non-pulsating.

What is claimed is:

1. In a gas operated free piston pumping apparatus having at least first, second and third piston assemblies mounted within respective cylinders for reciprocation therein through intake and exhaust strokes for providing liquid under pressure responsive to controlled application of gas under pressure thereto, the improvement comprising:

a three way control valve for each piston assembly, each of said control valves having first and second positions;

first means for positioning the control valve associated with each piston assembly in its first position to provide gas under pressure to its associated piston assembly responsive to another piston assembly approaching completion of its pump exhaust stroke; and second means for positioning the control valve associated with each piston assembly in its second position responsive to its associated piston assembly completing its pump exhaust stroke for removing gas under pressure from said associated piston assembly and venting said associated piston assembly.

2. Apparatus as defined in claim 1 wherein each of said control valves includes detent means for positive positioning of each said control valve alternately in its first and second positions.

3. Apparatus as defined in claim 2 further including means for positioning each of said control valves in a predetermined position in the absence of gas under pressure applied thereto.

4. Apparatus as defined in claim 3 wherein said means for predetermined positioning includes a spring loaded plunger for each control valve disposed to contact its associated control valve in the absence of gas under pressure and to retract to a non-contacting position upon application of gas under pressure to said apparatus.

5. Apparatus as defined in claim 1 wherein each of said piston assemblies includes first and second pistons interconnected by a piston rod, and a gas cylinder chamber and a liquid cylinder chamber for receiving said first and second pistons respectively.

6. Apparatus as defined in claim 5 wherein said first means includes a first normally closed port defined by each of said gas cylinders and passageway means connecting each said first port to a control valve associated with a different piston assembly.

7. Apparatus as defined in claim 6 wherein said second means includes a second normally closed port defined by each of said gas cylinders and passageway means connecting each said second port to the control valve associated therewith.

8. Apparatus as defined in claim 7 wherein said first and second ports are opened by said first piston, said first port being opened as said first piston approaches the end of its exhaust stroke and said second port being opened as said first piston completes its exhaust stroke.

9. Apparatus as defined in claim 5 wherein said liquid cylinder and said second piston define a captured volume of liquid at the completion of the exhaust stroke to limit the travel of said piston assembly.

10. Apparatus as defined in claim 5 wherein said gas piston assembly defines a captured volume of gas at the completion of the intake stroke to limit the travel of said piston assembly.

* * * * *